United States Patent [19]

Kaulfuss et al.

[11] Patent Number: 4,925,429

[45] Date of Patent: May 15, 1990

[54] CONSTRUCTION TOY WITH CONNECTABLE PORTIONS

[75] Inventors: William P. Kaulfuss, Wilmette; Robert H. Kaulfuss, Northbrook, both of Ill.

[73] Assignee: Kaulfuss Designers, Inc., Chicago, Ill.

[21] Appl. No.: 200,650

[22] Filed: May 31, 1988

[51] Int. Cl.[5] ..... A63H 33/00

[52] U.S. Cl. ..... 446/487; 446/488

[58] Field of Search ..... 446/488, 387, 388, 109, 446/487; 2/171.1, 171.2, 171.3, 171.4, 171.5, 171.6, 171.7, 171.8, 192, 195

[56] References Cited

U.S. PATENT DOCUMENTS

| | | | |
|---|---|---|---|
| 381,391 | 4/1888 | Law | 446/387 |
| 565,994 | 8/1896 | King | 446/387 |
| 585,092 | 6/1897 | Gibson | 446/388 |
| 1,023,420 | 4/1912 | Eaton | 446/388 |
| 1,180,591 | 4/1916 | Lee | 446/388 |
| 1,240,887 | 9/1917 | Scott, Jr. | 446/388 |
| 1,292,191 | 1/1919 | Wiederanders | 446/387 |
| 1,438,083 | 12/1922 | Baker | 446/388 |
| 2,023,104 | 12/1935 | Schwartz | 446/387 |
| 2,148,290 | 2/1939 | Cloud | 446/387 |
| 2,170,953 | 8/1939 | Spots | 446/388 |
| 2,189,550 | 2/1940 | Higgins | 446/387 |
| 2,237,897 | 4/1941 | Vos | 446/388 |
| 3,212,214 | 10/1965 | Patterson | 446/388 |
| 4,087,576 | 5/1978 | Patterson | 446/109 |

*Primary Examiner*—Robert A. Hafer
*Assistant Examiner*—Michael Brown
*Attorney, Agent, or Firm*—Walter C. Ramm

[57] ABSTRACT

A simple construction toy of thin, planar flexible material, and characterized also by some stiffness and resilience, wherein two generally similar and opposable sides extend from a connective member, and each side has a remote free end. The toy is manually assembled by flexing the sides about the connective member and hooking them together near the remote free ends. Thus-assembled, the toy's sides bow outwardly. Inequality between the connected lengths of the sides imparts moderate asymmetry to the bowed sides, and contributes to a three-dimensional effect. Where the toy has legs, the asymmetry enhances its stance. One or several of the toys may be presented within a larger sheet of such material and adapted easily to be taken from the sheet.

8 Claims, 2 Drawing Sheets

Fig. 1
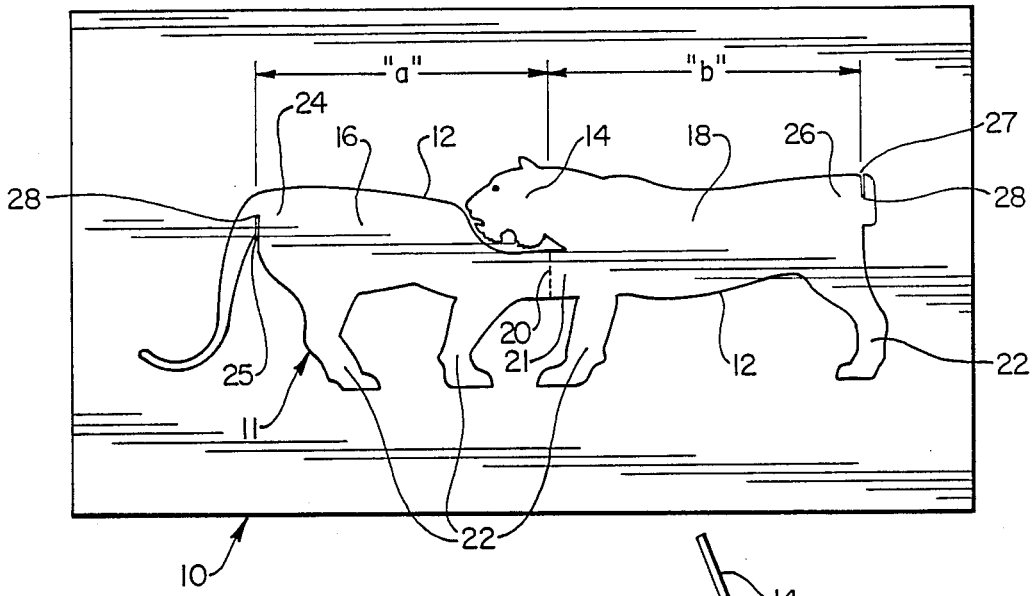
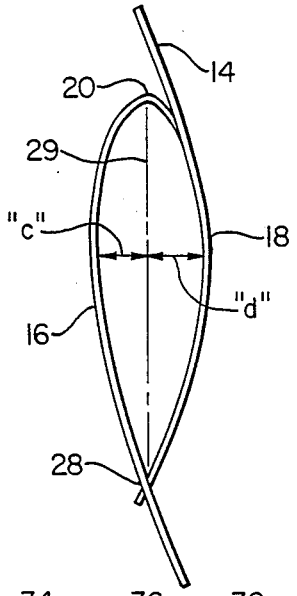
Fig. 2
Fig. 3
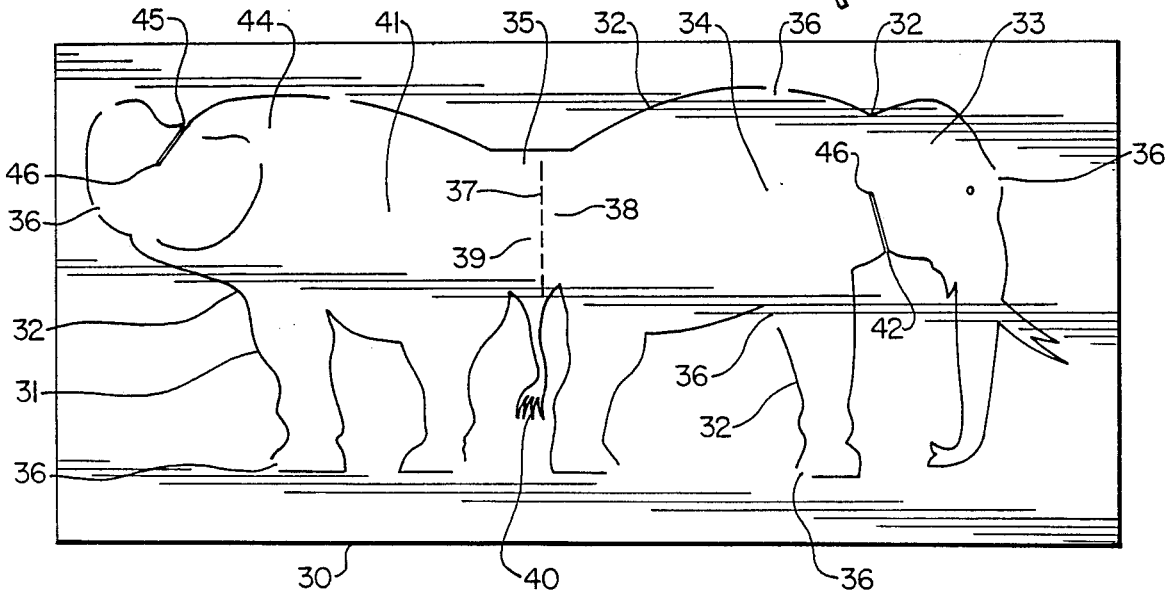

CONSTRUCTION TOY WITH CONNECTABLE PORTIONS

BACKGROUND OF THE INVENTION

1. Field of the Invention

This invention is in the field of simple construction toys and relates specifically to toy-figures originating as a planar piece and having resilient, inter-connected portions.

2. Description of Related Art

The related art includes the disclosures of these United States patents for paper and cardboard construction-type dolls and other toy articles: No. 1,392,981—cardboard or paper doll figures joined by tabs and slots means in a ring; No. 1,434,940—several cardboard dolls in chain-like inter-connection, enabled by slit means; No. 2,944,368—doll apparel formed as a single piece of resilient material, with front and sides, to engage with a bas-relief type doll; No. 3,073,059—a planar doll figure, with folded-together (at the head) front and back sides. No. 4,227,340—a contoured-front paper doll adapted to fit with other clip-on toy figures such as a horse and an auto.

The related art may also include flexible sheet elements for use in the construction of hollow or shell-like bodies such as is disclosed in U.S. Pat. No. 3,895,225.

SUMMARY OF THE INVENTION

The objects of this invention are (i) to provide an inexpensive, manually-assembled toy simulating in small-scale a three-dimensional figure or object; (ii) to impart stability and realistic appearance to such a toy, and (iii) to afford young children worthwhile instructive opportunities to accomplish a simple assemblage and, additionally, for enjoyable play with the assembled article.

The toy originates as a planar piece of material on which the toy-figure is at least peripherally defined. The material is a thin flexible ply, perforable or easily cut by scissors, and further characterized by stiffness and resilience.

The toy-figure includes a first side, a generally-corresponding second side, and a transition portion (or "transition") as a flexed connective element between the two sides. The transition is defined in terms of a transition-line, as such a line, or as a zone proximate the line. In addition to the transition-connection, the two sides are mutually connectable—by slitted portions serving as hooks—at a distance relatively remote from the transition. The toy-figure may be intended to represent an animal and, typically, in such figures, legs depend from the animal's body.

Hooked together, the slits of the figure's slitted portions locate a connection-point. The connection-point and transition-line define a longitudinal axis for the assembled figure. Each of the figure's sides has an unflexed connected-length, that is, a comparably-reckoned distance between transition-line and connection-point. If the connected-lengths of the two sides are unequal, the result is an asymmetry of the connected sides relative to the axis, and a characteristic asymmetric bowed relationship between the sides.

This bowed relationship imparts significant breadth to the toy. Where the toy includes, for example, legs, the breadth provides for a stable stance and, additionally, enables a natural disposition and life-like proportions to the legs. Such disposition and proportion distinguish this invention from tent-like, fold-across-the-top forms of toy animal figures in which the legs are unnaturally large and splayed.

BRIEF DESCRIPTION OF THE DRAWINGS

FIG. 1 is a lay-out of a toy-figure of a construction toy of this invention on a larger sheet of planar material. The toy-figure, a tiger, faces toward the left.

FIG. 2 is a plan view of the upper edges of the toy-figure of FIG. 1, showing bilateral asymmetry. The toy-figure is removed from the larger sheet, and assembled, and the thickness of the material is somewhat exaggerated.

FIG. 3 is a layout of a toy-figure of a construction toy of this invention, having a posterior zone defined by the transition-line, on larger planar material. The toy-figure is an elephant facing toward the right.

FIG. 4 is a sketch showing the toys of FIGS. 1 and 3 in assembled condition.

DESCRIPTION OF PREFERRED EMBODIMENTS

Figure 5:
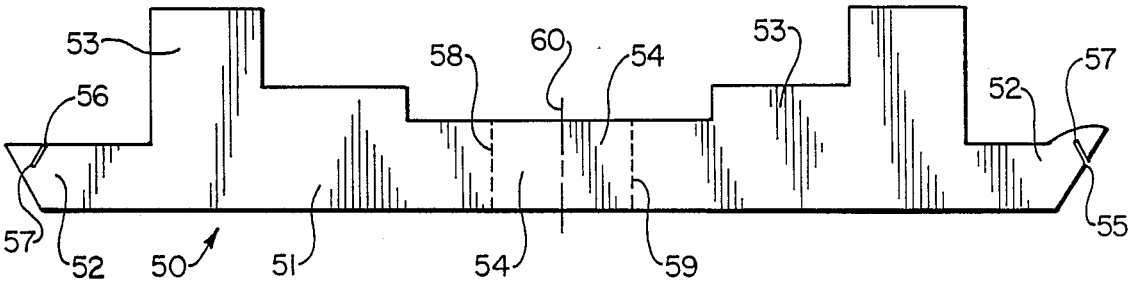
FIG. 5 is a plan view of a toy-figure of a construction toy of this invention, without reference to any larger sheet, and having two crease-lines in the zone located by the transition-line.

FIGS. 1, 3 and 5 generally depict lay-outs of preferred embodiments of this invention. Reference numerals identify parts of the lay-outs or their aspects, as follows: in FIG. 1, 10 is a sheet of material, 11 is the toy-figure or toy (a tiger), 12 is the peripheral outline of toy 11, 14 is the head (showing an eye of the tiger) of toy 11, 16 is the left side of toy 11, 18 is the right side of toy 11, 20 is the transition-line, 21 is the connective element, 22 is each of four legs, 24 is a slitted portion near the rear of left side 16, 25 is the slit of portion 24, 26 is a slitted portion near the rear of right side 18, 27 is the slit of portion 26, and 28 is the connection-point (to be defined by slits 25 and 27 when they are hooked together); also, characters "a" and "b" respectively identify line-segments representing the connected-lengths of left side 16 and right side 18. Segment "a" is shorter than segment "b".

FIG. 2 employs the same numerals as in FIG. 1; also, 29 is the longitudinal axis of assembly toy 11, and characters "c" and "d" respectively identify line-segments representing the transverse distances between axis 9 and left side 16 and right side 18. Segments "c" and "d" are co-linear, and "c" is shorter than "d."

In FIG. 3, 30 is a sheet of material, 31 is a toy (an elephant), 32 (the dark line) indicates exemplary ones of the plurality of cuts in sheet 30 that serve to define the perforate outline of toy 31, 33 is the head-neck portion of toy 31, 34 is the left side of toy 31, 35 is the transition portion or connective member of toy 31, 36 indicates exemplary ones of the plurality of small yet-unbroken portions in the perforate outline of toy 31, dashed line 37 represents the transition-line, 38 is the left margin of member 35, 39 is the right margin of member 35, 40 is the tail of toy 31, 41 is the right side of toy 31, 42 is a slit in head-neck portion 33, 44 is a slitted portion near the front of right side 41, 45 is the slit of portion 44, and 46 is the connection-point defined by slits 42 and 45.

Figure 4A:
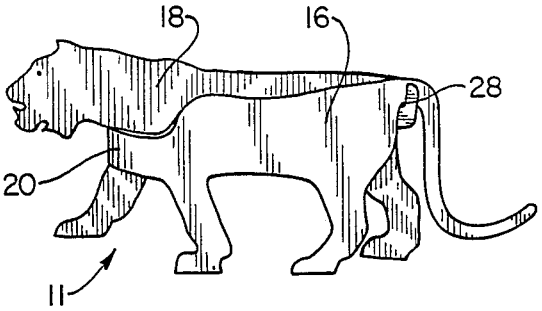
FIG. 4A is the tiger.
Figure 4B:
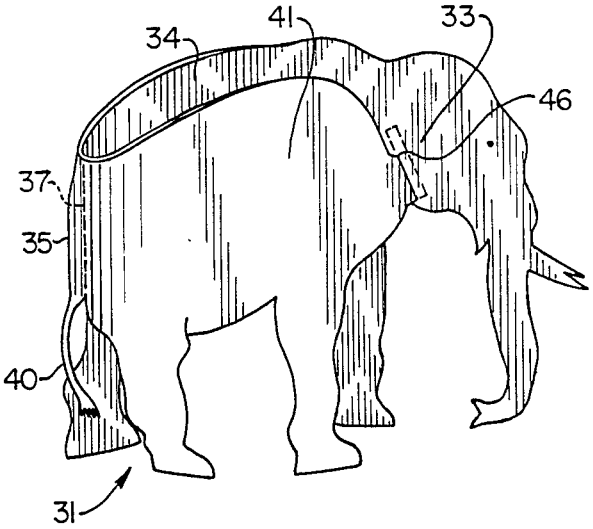
FIG. 4B is the elephant.

FIG. 4A utilizes the reference numerals of FIG. 1, and FIG. 4B, the numerals of FIG. 3.

Figure 6:
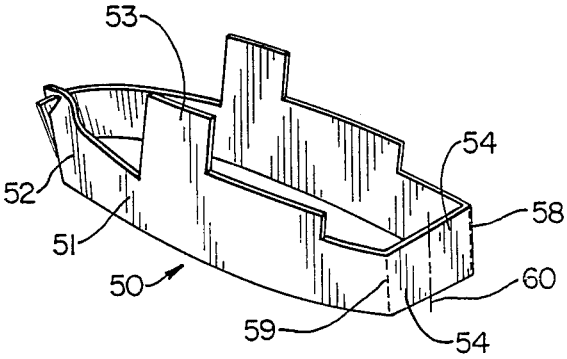
FIG. 6 is a sketch showing the toy of FIG. 5 in assembled condition. The toy-figure is a boat with the waterline as its lower edge.

In FIG. 5, 50 is a toy (a boat), 51 is the hull of toy 50, 52 is the forward slitted portion of hull 51, 53 is the superstructure, 54 is the connective zone—like a stern or transom—of toy 50, 55 is the starboard-side slit, 56 is the port-side slit, 57 is the connection-point defined by slits 55 and 56, and 60 is the transition line. Broken line 58 indicates a first crease-line, and broken line 59 is a second crease-line. FIG. 6 utilizes the reference numerals of FIG. 5.

Figure 7:
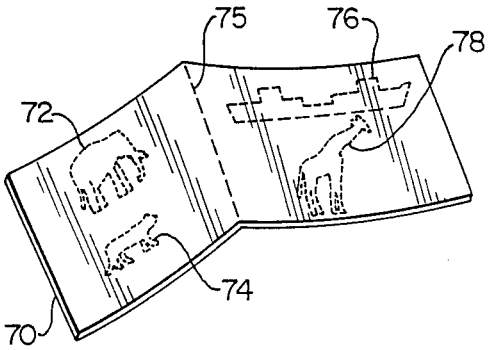
FIG. 7 is a sketch showing the layout of several toy-figures, each defined by its own demarcation, on a single sheet of planar material.

In FIG. 7, numeral 70 is a sheet of material, 72 is a first demarcation of the silhouette and the slits of a first toy-figure (such as elephant 31 in FIG. 3), 74 is a second such demarcation for a second such toy-figure, dashed line 75 is a fold in sheet 70, 76 is a third such demarcation for a third such toy-figure, and 78 is a fourth such demarcation for a fourth such toy-figure. Demarcations 72 and 74 are imprinted curves and lines. Demarcations 76 and 78 are perforations.

The preferred embodiment of this invention may be described from the standpoints of the toy-figure in a larger context, as in FIGS. 1 and 3, and the toy, itself, apart from or without reference to a larger sheet, as in FIGS. 4 and 5. From either standpoint a preferred embodiment requires suitable material. Such material is essentially planar or sheet-like in origin and usually a single thin ply, perforable or easily cut by scissors. Further, the material is characterized by flexibility so that it may be flexed, bent or folded over from an original planar condition; resiliency so that, when flexed, bent or folded over—once or several times—it has arcuate form and tends to return to planar condition; and, stiffness so that it tends to retain an established conformation. In some instances, it may be of advantage that the material be able to receive and retain creases. Generally, thicker construction papers or other papers, cardboard, or tag board are suitable materials.

Concerning the larger context, FIG. 1 shows toy 11 as part of larger sheet 10, and FIG. 3 shows toy 31 as a part of larger sheet 30. The toy-figures may be produced on the larger sheet by a conventional printing or reproduction process. Toy 11 is to be scissors-cut from sheet 10 along outline 12. Toy 31 has perforate silhouette, and is to removed from sheet 30 by breaking the small connections 36; thus, sheet 30 must be perforable. Such perforations and the toy's slits may be die-cut. If presented only as a silhouette the toy may be colored by crayon or painted before it is taken from the larger piece or is assembled.

Toys such as toy 50 may be separately produced and utilized as discrete articles without reference to any larger context or sheet. The edges and slits of toy 50 may be, for example, die-cut.

Separately produced or taken from the larger sheet, the preferred embodiments have the same characteristics. The toy's two slitted portions—such as portions 24 and 26 is FIG. 1 and the forward portions 52 in FIG. 5—are in effect free ends. The slits—numerals 25 and 27 in FIG. 1, and 56 and 57 in FIG. 5.—are open and, when the slitted portions are hooked together, they define the connection-point—numeral 28 in FIG. 1 and numeral 58 in FIG. 5.

The toy is manually assembled by flexing, bending, or folding the two sides toward each other; such actions may be hinge-like of at least one of the sides (and its free end) relative to an axis of rotation. When such actions are complete, the slitted portions (or free ends) are hooked together to connect the sides, as in FIGS. 4 and 6. FIG. 2 shows that, in plan view and as assembled, the sides assume and have a bowed or curved perimeter.

The axis of rotation is defined by the transition-line—line 20 in FIG. 1, line 37 of FIG. 3 and line 60 of FIG. 5. The transition-line is at or close to the portion of the described curve at maximum straight-line distance from the connection-point. Theoretically, the transition-line may be considered as at the maximum radius of curvature of such curve or—moving from one side of the toy to the other, including the connective element—such as member 35 in FIG. 3—where the tangent to such curve would "transition" from positive to negative slope. Practically, it may be a simple, somewhat sharp bend or a crease, or it may locate within a narrow zone proximate the point of tangential transition, such as member 35.

FIG. 2 shows transition-line 20 and connection-point 28 defining longitudinal, chord-like axis 29, and that sides 16 and 18 bow or bulge outwardly from axis 29. The resilient property of the material contributes to the bowed effect, and to the desired and thus-effected three-dimensional appearance of the assembled toy. The transition-line and the connection-point also define, for each side of the toy, a characteristic connected-length. If the two connected-lengths are equal, the toy is effectively bilaterally symmetrical between the transition-line and the connection-point.

In many toys of this invention, an inequality between the connected-lengths of the respective sides provides a moderate intentional asymmetry. Such asymmetry avails to impart or enhance the desired bowed effect. Each side exerts a bowing effect on the other, but usually the side with the shorter connected-length is relatively stronger. The unequal segments "a" and "b" of FIG. 1 show the connected-length of right side 18 of toy 11 to be shorter than the connected-length of left side 16. Correspondingly, in FIG. 2, segment "c", relative to segment "d," shows left side 16 to bow outwardly of axis 29 more than right side 18.

The asymmetry affords notable breadth to the toy. Where the toy-figure has legs or similar appendages—and distinct from a general contribution to the three-dimensional appearance—this breadth specifically provides a stable stance. In the length-wise view, the tiger's legs 22 have vertical disposition relative to the body, and, as shown in FIG. 4A, provide a four-point stance with a substantial transverse component. A three-point stance, as well, would likely suffice. If a toy with legs lacks such an opportune transverse component, stability is at best impaired and, probably, absent altogether. Further, this stance enables appendages to have natural proportions and a natural, generally vertical disposition, and, on the toy's small scale, realistically to be depicted, as in legs 22.

The inequality between the sides' connected-lengths should not be great enough to produce undue asymmetry or distortion in the toy.

The resilience of the toy may be influenced in minor degree by particular shapes. Flexed-together portions—such as sides 34 and 39 of toy 31 in FIG. 4B—should not be so large or weighty relative to an inherent tendency for a return-moment—exerted in member 35 (and about transition-line 37)—to impair or negate the moment.

Toy 50 is an essentially symmetric figure, and has a broad connective zone 54. As assembled, it has a shallower or broader bowed effect to stern zone 54 than, for example, the relatively deep or sharp transition bend at the tiger's chest, along line 20 in FIG. 2, in toy 11. As a sort of implementing detail that these toys may be provided with, the forward starboard side of hull 52 needs a slightly enlarged portion to accommodate slit 55. When slits 55 and 56 are hooked together, appropriate creases along lines 58 and 59 will tend to square off zone 54 and increase its simulative appearance as a transom. FIG. 6 suggests the effect of the creases along lines 58 and 59; the creases are at substantially equal distance from line 60 and serve to define zone 54.

The respective pairs of slits, when functioning as the hooks in toys 11, 31 and 50, are readily releasable. Thus, the toys may be unhooked and then re-assembled several times, augmenting their play value.

FIG. 7 illustrates that a number of toy-figures, each defined by, for example, an imprinted silhouette or a perforate edge, may be advantageously presented in combination on a single sheet of suitable planar material.

In an exemplary preferred embodiment, seven distinct toy animal figures form a collective presentation. The presentation is on a single plain and uncolored sheet of 150 lb. tag board; the widely-available "Springhall" brand of tag board product serves well in this connection. The animals are a tiger (toy 11 of FIG. 1), an elephant (toy 31 of FIG. 3), a gorilla, a rhinocerous, an hippotamus, a zebra, and a giraffe. The tiger's connected-lengths are, on side 16 (segment "a" of FIG. 1) approximately $4\frac{3}{4}$ inches, and on side 18 (segment "b" of FIG. 1), 5 inches; when the tiger is assembled and standing, the lower extremity of each leg 22 is at $2\frac{1}{4}$ inches vertical distance below connection point 28. In the elephant the connected-lengths of the sides are $4\frac{7}{8}$ inches and $5\frac{1}{2}$ inches, and the legs uniformly terminate 3 inches below connection-point 46.

The animal figures of this exemplary presentation, and the slits therefor, are defined by perforate edges or lines. The figures have small holes suggestive of eyes, but no other illustrational matter is provided. The overall dimensions of the sheet are approximately $11\frac{1}{4}$ inches by 35 inches, and it is folded to be received in an envelope. The envelope carries a crayon-coloring guide and assembly instructions, and the slits are identified by small size "A" and "B" letters to correlate with the instructions.

Many other specific embodiments are within the spirit and scope of this invention.

What is claimed is

1. A toy figure of flexible planar material comprising a transition portion including a transition-line;

a first side extending from the transition-line, and having a first-side end and a slitted portion defining a first slit proximate the first-side end;

at least one first-side appendage adapted to depend from the first side;

a second side extending from the transition-line, having a second-side end and a slitted portion defining a second slit proximate the second-side end, and being generally opposed to the first side and adapted to cooperate with the first side to comprise hook means and to define a connection-point; and, second-side appendages adapted to depend from the second side;

wherein the distance between the connection-point and the transition-line along the first side differs from a corresponding distance along the second side, so that when the material is flexed and the hook means are engaged to connect the ends, the connection-point and the transition-line define a chord-like axis, the sides bow outwardly of and are asymmetric relative to the axis, and the toy is adapted to stand on at least some of the appendages.

2. The toy figure of claim 1 where at least some of the appendages are legs, and, as the toy is adapted to stand on the legs, the legs are in a generally vertical disposition and define a uniform vertical distance relative to the connection-point.

3. A construction toy of thin flexible planar material comprising a transition portion including a transition-line;

a first side extending from the transition portion, having a first-side end and a slitted portion defining a first slit proximate the first-side end; and, p1 a second side extending from the transition portion, the second side being generally opposed to the first side, having a second-side end and a slitted portion defining a second slit proximate the second-side end, and being adapted to cooperate with the first slit to comprise hook means and to define a connection-point;

wherein the distance between the connection-point and the transition-line along the first side differs from the corresponding distance along the second side, so that when the material is flexed and the hook means engaged to connect the two ends, the connection-point and the transition-line define an axis, and the said sides bow outwardly of and are asymmetric relative to the axis.

4. The construction toy of claim 3, comprising a toy figure, where the planar material is paper, and wherein the transition portion is a bend in the paper and the bend includes the transition-line.

5. A presentation comprising a sheet of thin flexible planar material, and a demarcation, on and within the edges of the sheet, which defines the silhouette and the slits of the toy of claim 3 as to be separable from the sheet.

6. The presentation of claim 5 wherein the sheet carries a plurality of the demarcations.

7. The presentation of claim 5 wherein the planar material has paper-like properties and may be scissors-cut along the demarcation.

8. The presentation of claim 6 where the demarcations are perforate.

* * * * *

UNITED STATES PATENT AND TRADEMARK OFFICE

CERTIFICATE OF CORRECTION

PATENT NO. : 4,925,429

DATED : May 15, 1990

INVENTOR(S) : William P. Kaulfuss and Robert H. Kaulfuss

It is certified that error appears in the above—identified patent and that said Letters Patent is hereby corrected as shown below:

Column 6, line 24, cancel beginning with '3. A construction toy' to and including 'to the axis.' in column 6, line 44, and insert the following claim:

"3. A construction toy of thin flexible planar material comprising
a transition portion including a transition-line;
a first side extending from the transition portion, having a first-side end and a slitted portion defining a first slit proximate the first-side end; and,
a second side extending from the transition portion, the second side being generally opposed to the first side, having a second-side end and a slitted portion defining a second slit proximate the second-side end, and being adapted to cooperate with the first slit to comprise hook means and to define a connection-point;
wherein the distance between the connection-point and the transition-line along the first side differs from the corresponding distance along the second side, so that when the material is flexed and the hook means engaged to connect the two ends, the connection-point and the transition-line define an axis, and the said sides bow outwardly of and are asymmetric relative to the axis."

Signed and Sealed this

Third Day of September, 1991

*Attest:*

HARRY F. MANBECK, JR.

*Attesting Officer*

*Commissioner of Patents and Trademarks*